US005976613A

United States Patent [19]

Janusauskas

[11] Patent Number: 5,976,613

[45] Date of Patent: Nov. 2, 1999

[54] METHOD OF MAKING AN ELECTROLUMINESCENT LAMP

[76] Inventor: Albert Janusauskas, 110 Brickyard Rd., Farmington, Conn. 06032

[21] Appl. No.: 08/597,735

[22] Filed: Feb. 6, 1996

Related U.S. Application Data

[63] Continuation-in-part of application No. 08/101,413, Aug. 3, 1993, Pat. No. 5,491,377.

[51] Int. Cl.[6] ..... B05D 5/06; H01J 1/70

[52] U.S. Cl. ..... 427/66; 427/126.3; 427/282; 427/255.32; 427/419.2; 204/192.17; 313/503; 313/506; 313/509

[58] Field of Search ..... 427/66, 100, 108, 427/126.3, 419.2, 255.32, 282; 313/503, 506, 509; 204/192.17

[56] References Cited

U.S. PATENT DOCUMENTS 5,276,382 1/1994 Stocker et al. ..... 313/506
5,491,377 2/1996 Janusauskas ..... 313/506
5,557,295 9/1996 Miyashita et al. ..... 345/36
5,646,481 7/1997 Zovko ..... 313/510
5,660,573 8/1997 Butt ..... 427/66

*Primary Examiner*—Shrive Beck
*Assistant Examiner*—Bret Chen
*Attorney, Agent, or Firm*—Rogers & Killeen

[57] ABSTRACT

A thick film, electroluminescent lamp and method of construction in which a single non-hygroscopic binder is used for all layers (with the optional exception of the rear electrode), thereby reducing delamination as a result of temperature changes and the susceptibility to moisture. The use of a common binder for both phosphor and adjacent dielectric layers reduces lamp failure due to localized heating, thus increasing light output for a given voltage and excitation frequency, and increasing the ability of the lamp to withstand overvoltage conditions without failure. Layers may be provided on both sides of a common rear electrode to provide a lamp with two independently operable lamp surfaces. A front electrode may be exposed on a side of the lamp with the rear electrode by cutting the layers down to the front electrode after the layers have been joined.

22 Claims, 2 Drawing Sheets

METHOD OF MAKING AN ELECTROLUMINESCENT LAMP

This is a continuation-in-part of application Ser. No. 08/101,413 filed Aug. 3, 1993, now U.S. Pat. No. 5,491,377.

BACKGROUND OF THE INVENTION

A thick film electroluminescent ("EL") lamps are well known and generally comprise a phosphor between an optically transparent front electrode layer and a back electrode layer, all covered by a protective layer. The two electrodes are generally planar layers, but may be grids of electrically conductive material disposed at right angles to each other so that the phosphor at selected grid coordinates can be excited.

In general, different methods are used for depositing the various layers of thin film lamps than are used for thick film lamps. In contrast to thin film lamps made by vacuum deposition of the various layers, usually on glass, thick film lamps are generally made by roller coating the various layers, i.e., from the back forward on foil or a metalized polyester back electrode, or from the front backward on an indium tin oxide ("ITO") sputtered heat stabilized polyester used as the transparent front layer. More recently as shown for example in the Mental U.S. Pat. No. 4,626,742 dated Dec. 2, 1986, the various layers including the electrical connections thereto have been screen printed on a transparent polyester base, particularly where the lamps are of unusual sizes and/or shapes.

A problem common to all of the known techniques for making lamps is the protection of the layers, particularly the phosphor, from moisture. Moisture gives rise to dielectric breakdown and is highly detrimental to both lamp longevity and performance.

Moisture is particularly a problem in the favored screen printing process where the binder resin for the various layers is generally hygroscopic, and where the highly hygroscopic cyanoethyl cellulose, often blended with cyanoethyl starch or sucrose, are commonly used. The traditional approach to the moisture problem, as shown for example in the Schimizu U.S. Pat. No. 5,188,901 dated Feb. 23, 1993 and the Kawachi U.S. Pat. No. 4,767,679 dated Aug. 30, 1988, is the encapsulation of the entire lamp in a fluoropolymer or PTCFE film. However, such encapsulation is an expensive and time consuming process.

It is accordingly an object of the present invention to obviate the moisture problem by use of a non-hygroscopic binders throughout the manufacturing process.

It is another object of the present invention to provide a novel EL lamp and process in which the need for an external protective encapsulation is obviated.

One known method of attacking the moisture problem has been to coat the individual phosphor particles with a thin layer (e.g., 0.4 microns) of aluminum oxide. Such lamps, when used with a traditional binder system and overcoating, have shown enhanced moisture resistance, but provide only about one half the illumination of the more traditional uncoated phosphor lamps for the electrical power applied to them.

It is accordingly an object of the present invention to reduce the moisture problem without sacrificing significant illumination by the use of individually coated phosphor particles.

Alternatively, it is another object of the present invention to use the moisture resistant characteristics of individually coated phosphor particles in a lamp capable of operating at higher voltage and frequencies so as to retain the illumination levels of non-coated phosphor particles.

In another aspect, the light emitted by a thick film EL lamp is of course related to the excitation of the phosphor by the electrical current through the lamp, and the current is inversely related to the capacitive reactance and is thus a function of the frequency of the applied electrical signal, i.e., the higher the frequency the lower the capacitive reactance and the brighter the lamp.

However, the use of high frequency excitation of EL lamps presents a problem in the stability of the dielectric. When a lamp is operated at high voltage and above 900 to 1,000 Hz, local heating in the dielectric layer is due to the resistive dissipation of heat in the dielectric/phosphor junction. For this reason, and because of brightness and color rendition, the specifications for most lamps require operation between 400 Hz and 2,000 Hz at 115 volts.

The failure of foil backed lamps from dielectric breakdown is catastrophic, for a low impedance shunt is thereby established between the electrodes. For ITO sputtered polyester front electrode lamps, the electrode generally fuses to open the circuit around the area of dielectric breakdown, producing a dark spot. As the dielectric continues to breakdown, other spots appear quickly degrading the performance of the lamp to an unacceptable level.

It is accordingly an object of the present invention to reduce the incidence of the dielectric breakdown in EL lamps by the use of a common binder in the phosphor and dielectric layers.

It is another object of the present invention to provide a novel EL lamp and process in which the diffusion at the dielectric/phosphor junction is significantly increased.

It is still another object of the present invention to provide a novel EL lamp and process in which the effective surface layer of the phosphor is significantly increased.

It is yet another object of the present invention to provide a novel EL lamp and process which is capable of both continued operation at a higher excitation frequency and intermittent operation (and thus high brightness) at greatly increased excitation frequencies.

In still another aspect, the temperature at which an EL lamp operates often causes delamination or separation of the various layers because of unequal coefficients of expansion of the binders used in the layers. Uneven expansion causes flexing and localized stress which often increases the incidence of failure.

It is accordingly an object of the present invention to obviate the problem of localized stress by use of binders for the various layers which have an uniform coefficient of thermal expansion.

It is another object of the present invention to provide a novel EL lamp and process with significantly reduced mechanical damage as a result of the inherent localized thermal effects due to lamp operation.

In yet another aspect, the darkening of the phosphor in thick film EL lamps has been a problem as a result of ultraviolet ("UV") radiation from exposure to sunlight. The prior art has attempted to reduce the darkening of the phosphor from exposure to sunlight by laminating or coating the lamp with a UV resistant layer, but such layers and coatings have proven expensive and time consuming in the manufacturing process.

It is accordingly an object of the present invention to reduce the problem of UV degradation of the phosphor in an EL lamp by the use of a binder for the phosphor which is UV resistant.

It is another object of the present invention to provide a novel EL lamp and process with significantly reduced UV susceptibility without the need for an additional UV resistant layer or coating.

The control of different areas of illumination has long been a problem,and is addressed in the present invention by the use of multilayers, i.e., different phosphors may be screen printed or otherwise layered on the lamp in different steps to produce different colors, and the layering of dielectrics and metalized conductors over previous conductive layers permits electrical access to, and thus electrical control over, various areas of the lamp.

It is accordingly an object of the present invention to provide a novel EL lamp and process with enhanced electrical control over various areas of the lamp by the layering of dielectrics and conductors, and to provide lamps with different colors in different areas.

These and many other objects and advantages will be readily apparent to one skilled in the art to which the invention pertains from the claims and from a perusal of the following detailed description of preferred embodiments when read in conjunction with the appended drawings.

DESCRIPTION OF PREFERRED EMBODIMENTS

Figure 1:
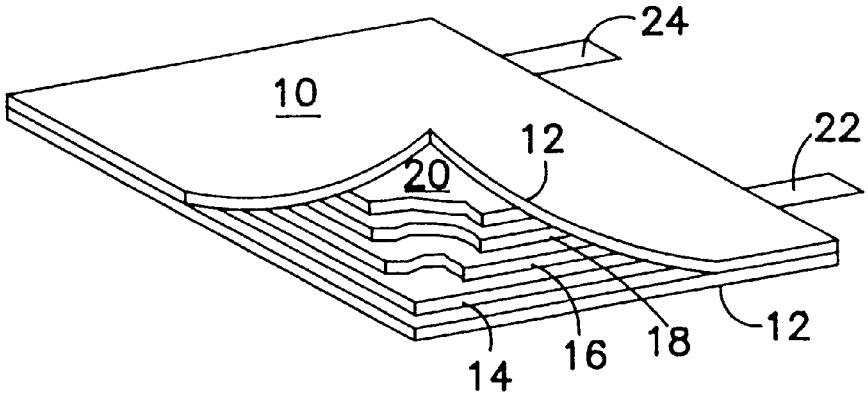
FIG. 1 is a pictorial view of a first embodiment of the lamp of the present invention.

Referring now to the drawings where exemplary embodiments of the electroluminescent cell or lamp of the present invention are illustrated, a flexible panel 10 such as shown in FIG. 1 may comprise a multilayer inner cell sealed within an outer moisture resistant envelope 12.

Within the active cell are four layers, i.e., a front electrode 14, a phosphor 16, a dielectric 18 and a rear electrode 20. The electrodes 14 and 20 may be provided with external silver leads 22 and 24 respectively in the screen printing process, or alternatively with ribbon connectors each being adapted for connection to a suitable source of a.c. power. As is well known in the art, the application of an electrical potential across the two electrodes 14 and 20 results in the excitation of the phosphor layer 16.

Figure 2:
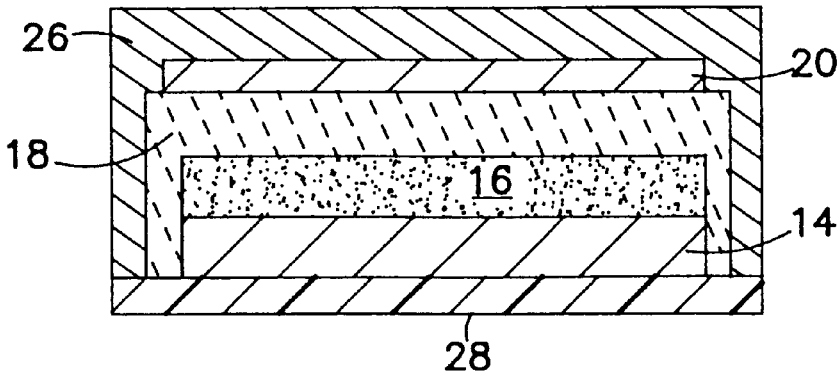
FIG. 2 is an elevation in cross-section of the lamp of FIG. 1.

As shown more clearly in the elevational view of a cross-section of FIG. 1 illustrated in FIG. 2, the phosphor 16 is immediately contiguous to the front electrode 14 but spaced from and electrically isolated from the rear electrode 20 by a dielectric layer 18. This phosphor sandwich is protected from the rear by an overcoat 26.

In the preferred screen printing manufacturing process, a suitable conventional heat stabilized polyester layer 28 such as the MELINEX® ST525 film 5,000 to 7,000 microns thick commercially available from Imperial Chemical Industries PLC in Wilmington, Del. may form the foundation for the screen printing of a front conductor 14 thereon, with the conductor comprising suitable conventional ITO compounds in 50–85% in a binder made from a fluoropolymer resin, desirably 2-(2-ethoxyethoxy)-ethyl acetate, 2-butoxyethyl acetate, and polyvinylidene fluoride. In the preferred embodiment of FIG. 2, the weight percent of the binder components are 5–25%, 5–25% and 2–30% respectively and the thickness of the front electrode is 20–25 microns dry.

The phosphor layer 16 may also be screen printed to a thickness of 45–50 microns dry and may include any suitable conventional phosphor such as copper activated zinc sulfide in the binder described above. In the preferred embodiment of FIG. 2, the copper activated zinc sulfide comprises 50–60 wt. %, the 2-(2-ethoxyethoxy)-ethyl acetate comprises 5–25 wt. %, the 2-butoxyethyl acetate comprises 5–25 wt. % and the polyvinylidene fluoride comprises 2–30 wt. %.

The dielectric layer 18 of FIG. 2 may include any suitable conventional white dielectric powder in the binder described above and screen printed to a thickness of 10–15 microns dry. In a preferred embodiment, the powder may be an admixture of titanium dioxide (20–60 wt. %), silicon dioxide (3–10 wt. %), and aluminum silicate (3–10 wt. %) and the binder in the same proportions described in connection with the phosphor layer 16.

The rear electrode 20 may also be screen printed to a thickness of 20–25 microns dry, and may include any suitable conventional conductive ink of silver, carbon, or ceramic, or blends of carbon silver or nickel silver in a binder as specified herein. In the preferred embodiment of FIG. 2, metallic silver (50–85 wt. %) may be used in a binder of 2-(2-ethoxyethoxy)-ethyl acetate (5–25 wt. %), 2-butoxyethyl acetate (5–25 wt. %) and polyvinylidene fluoride (2–30 wt. %).

The protective overcoat 26 may comprise any suitable conventional material such as TEFLON® PFA powder available from E. I. DuPont & Company in the binder screen printed to a thickness of 15–20 microns. In the preferred embodiment of FIG. 2, with 15–25 wt. % of TEFLON® #532-5011 powder, the weight percentages of the binder components are 2-(2-ethoxyethoxy)-ethyl acetate (10–45%), 2-butoxyethyl acetate (10–45%), and polyvinylidene fluoride (20–80%).

Figure 3:
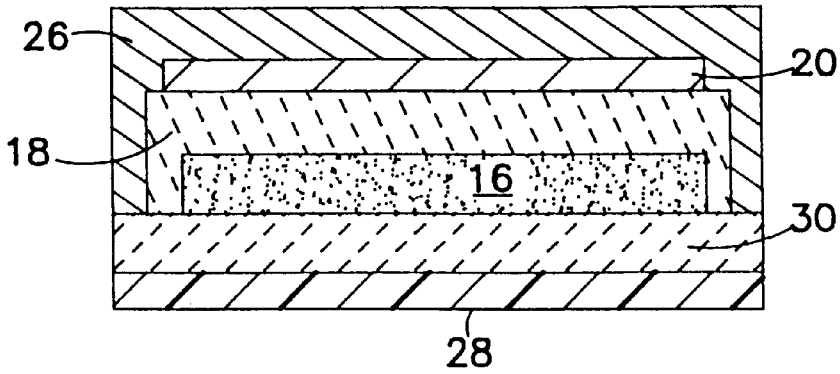
FIG. 3 is an elevation in cross-section of a second embodiment of the lamp of the present invention.

In the alternative embodiment shown in FIG. 3, the phosphor layer 16, the white dielectric 18, the rear electrode 20 and the protective overcoat 26 may be as described in connection with FIG. 2. However, the front electrode 28 may be a suitable conventional ITO sputtered polyester film with a sheet resistivity between about 300 ohms and 1,000 ohms per square, and a clear dielectric layer 30 may be screen printed thereon to a thickness of 2–5 microns dry to protect the electrode from moisture and abrasion. The clear dielectric layer 30 may comprise the formulation 2-(2-ethoxyethoxy)-ethyl acetate (10–45 wt. %), 2-butoxyethyl acetate (10–45 wt. %) and polyvinylidene fluoride (20–80 wt. %)

In both of the foregoing examples, a 2–10 wt. % of suitable conventional additives may be added to enhance the liquidity of the ink.

While not specifically illustrated in the drawings, the layering process easily achieved by screen printing permits the use of additional steps to print areas with different phosphors and thus different colors. Electrical access and thus control of the illumination of areas such as the concentric rings may be established by printing additional dielectric and conductive layers over previously printed conductive layers.

Figure 4:
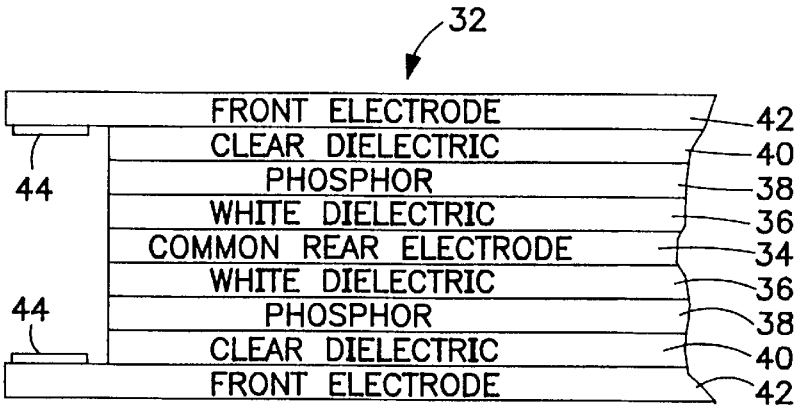
FIG. 4 is an elevation in cross-section of a third embodiment of the lamp of the present invention.

In a further embodiment of the invention the lamp may be two-sided, and the sides may be operated separately or at the same time. By way of example, and with reference to FIG. 4, a multilayer lamp 32 may include a common rear electrode 34 which may be a foil or a copper or screen printed silver, white dielectric layers 36 on each side of electrode 34, phosphor layers 38 on each side, clear dielectric layers 40 on each side, and front electrodes 42 on each side which may be 300 to 1,000 ohm per square ITO mylar 0.005 to 0.007 inches thick. Bus bars 44 may be provided for contacting front electrodes 42. As discussed above, the layers may be bound in a common binder and clear dielectric layers 40 may be omitted in some applications. Each lamp may be covered with a protective overcoat.

The manufacture of EL lamps may be further improved in a further embodiment of the invention by reducing the complexity of the manufacturing process. Prior art EL lamps typically are made in a process in which a bus bar pad is screen printed directly over the ITO layer so that an electrical connection can be made to the front electrode. The remaining layers are screened over the bus bar while leaving the pad exposed. A rear electrode is then screen printed and extended to its pad, with the front and rear electrode pads exposed after the insulating overcoat is applied. These procedures take from four to six steps, depending on lamp design. Further, silver has been the preferred screen printing conductor for the rear electrode, but is very expensive and drives up the cost of the lamp.

Figure 5:
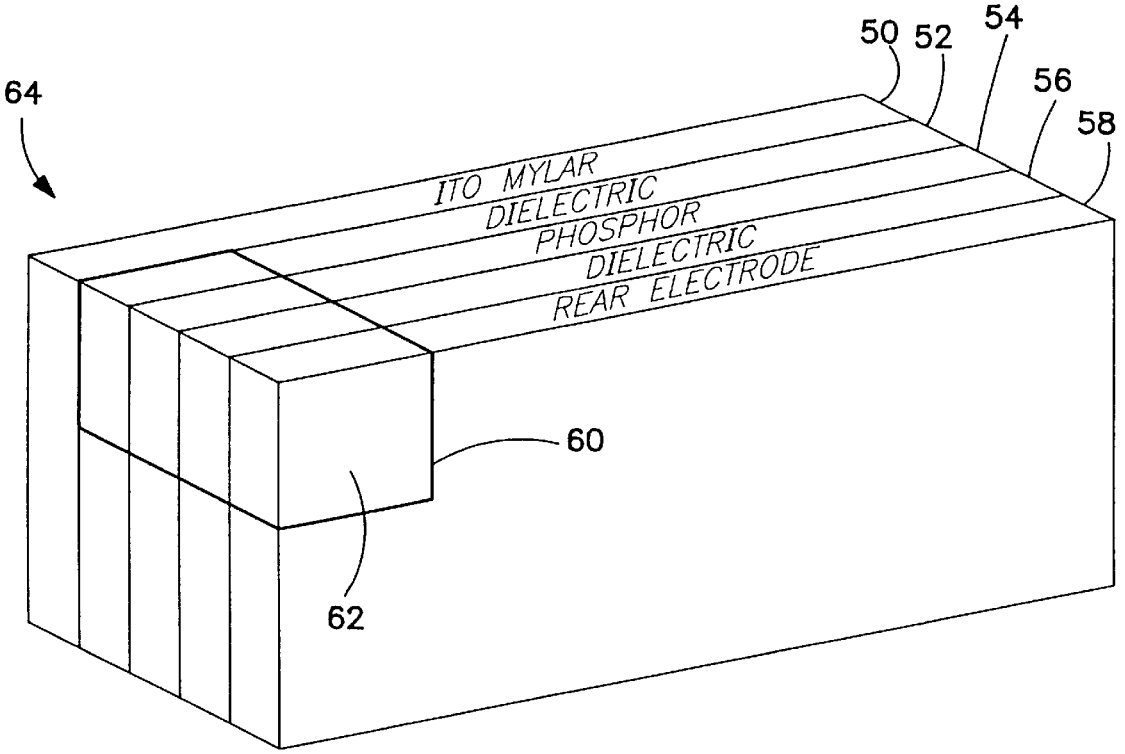
FIG. 5 is a pictorial representation of the manufacturing step of cutting the joined layers to expose the front electrode in the present invention.

This process is improved by providing manufacturing steps which can be easily automated, and which obviates the need for the expensive silver. A roll-to-roll, in-line, web coating and laminating machine may be used to provide a sheet from which a plurality of EL lamps may be separated. With reference to FIG. 5 which depicts a single lamp already separated from the sheet, each sheet may include an ITO mylar front conductor 50 which may be 0.003 to 0.007 inches thick and have a sheet resistance of 300 to 1,000 ohms per square, followed by a clear fluoropolymer dielectric layer 52, a phosphor layer 54 and a white dielectric layer 56. With all the layers in line, an aluminum or copper foil 0.002 to 0.003 inches thick may be laminated over the entire web width as the rear electrode 58.

This laminated product may then be further processed to form a front electrode contact area by kiss cutting along line 60 using a precision cutter, such as a platen die cutter with a steel rule die with either a center bevel or side bevel knife. Line 60 is cut down to ITO mylar layer 50 to separate a portion 62. The finished lamp 64 may be cut from the sheet along its edge to allow portion 62 to be removed to thereby expose ITO mylar layer 50 on the lamp side which has rear electrode 58. The front and rear electrodes are exposed to enable electrical contact therewith. Line 60 may positioned so as separate any appropriate portion, and is not limited to the embodiment shown. This process may be completely automated, and does not require silver screen printing. As discussed above, the layers may be bound in a common binder and clear dielectric layer 52 may be omitted in some applications. Each lamp may be covered with a protective overcoat which may be applied after the lamps are separated from the sheet.

ADVANTAGES AND SCOPE OF INVENTION

By use of a fluoropolymer binder such as polyvinylidene fluoride for all of the layers of the lamp, a thick film lamp may be produced which has high resistance to many chemical solvents, to ultraviolet and nuclear radiation, weathering, fungi and a low water transmission rate, i.e., comparable to ACLAR® PCTFE film commercially available from Allied-Signal, Inc. of Morristown, N.J.

The use of a common binder results in a lamp in which the various layers have a similar coefficient of temperature expansion, thus significantly reducing failures from exposure to an elevated temperature, and the inclusion of an ultraviolet absorbing component in the binder for at least the phosphor, and preferably all layers, obviates the need for and expense of an additional UV resistant coating.

The use of a common binder for both phosphor and adjacent dielectric layers reduces lamp failure due to localized heating, thus increasing light output for a given voltage and excitation frequency, and increasing the ability of the lamp to withstand overvoltage conditions without failure.

In addition, lamps constructed in accordance with the present invention have been found to produce more light at lower voltages and frequencies, and capable of withstanding higher voltages and frequencies without significant degradation of the lamp. In normal operation, it is possible to use individually coated phosphor with their enhanced moisture resistance without significant loss of illumination because of the ability to increase the operational voltage and/or frequency.

While acceptable for other methods of manufacture and deposition such as roller coating, sputtering and spraying, the binders of the present invention are particularly useful in the screen printing process. In addition, the printing process is particularly well suited to the printing of different phosphors in different layers of the lamp and the overprinting of conductive layers to achieve independent electrical control of various areas of the lamp.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A method of making a multilayer EL lamp comprising the steps of:

(a) binding an ITO layer in a first fluoropolymer resin binder, the ITO layer being on a polyester film of a front electrode layer;

(b) binding a phosphor layer in the first fluoropolymer resin binder;

(c) binding a dielectric layer in the first fluoropolymer resin binder; and (d) providing a rear electrode layer in a binder.

2. The method of claim 1 wherein each of the fluoropolymer resin binders includes polyvinylidene fluoride.

3. The method of claim 1 wherein the phosphor layer comprises individually coated phosphor particles.

4. The method of claim 1 wherein the step of binding the ITO layer comprises the step of forming the ITO layer from the following by weight, (a) indium oxide compounds (50–85%);

(b) 2-(2-ethoxyethoxy)-ethyl acetate (5–25%);

(c) 2- butoxyethyl acetate (5–25%); and (d) polyvinylidene fluoride (2–30%).

5. The method of claim 1 further comprising covering the ITO layer with a clear dielectric which comprises by weight:

(a) 2-(2-ethoxyethoxy)-ethyl acetate (10–45%);

(b) 2- butoxyethyl acetate (10–45%); and (c) polyvinylidene fluoride (20–80%).

6. The method of claim 1 wherein the step of binding the phosphor layer comprises the step of forming the phosphor layer from the following by weight:

(a) copper activated zinc sulfide (50–60%);

(b) 2-(2-ethoxyethoxy)-ethyl acetate (5–25%);

(c) 2-butoxyethyl acetate (5–25%); and (d) polyvinylidene fluoride (2–30%).

7. The method of claim 1 wherein the step of binding the dielectric layer comprises the step of forming the dielectric layer from the following by weight:

(a) titanium dioxide (20–60%);

(b) silicon dioxide (3–10%);

(c) aluminum silicate (3–10%);

(d) 2-(2-ethoxyethoxy)-ethyl acetate (5–25%);

(e) 2-butoxyethyl acetate (5–25%); and (f) polyvinylidene fluoride (2–30%).

8. The method of claim 1 further comprising the step of binding an overcoat layer in a second fluoropolymer resin binder.

9. The method of claim 8 wherein the step of binding the overcoat layer comprises the step of forming the overcoat layer from the following by weight:

(a) TEFLON #532-5011 powder (15–25%);

(b) 2-(2-ethoxyethoxy)-ethyl acetate (10–45%);

(c) 2-butoxyethyl acetate (10–45%); and (d) polyvinylidene fluoride (20–80%).

10. The method of claim 1 wherein steps (a)–(c) are carried out on a first side of the rear electrode layer, and further comprising the step of repeating steps (a)–(c) for a second front electrode layer, a second phosphor layer, and a second dielectric layer, respectively, on the opposing side of the rear electrode layer.

11. The method of claim 1 further comprising the step of exposing a portion of the ITO layer so that electrical contact can be made therewith from a side of the lamp having the rear electrode layer thereon.

12. The method of claim 11 wherein the step of exposing comprises the steps of cutting through the rear electrode layer, the dielectric layer, and the phosphor layer down to the ITO layer when the four layers are joined to form a removable cut portion, whereby the cut portion exposes the ITO layer when removed.

13. A method of making an EL lamp comprising the steps of:

(a) providing a heat stabilized polyester layer;

(b) depositing a front conductor on the polyester layer with the conductor comprising ITO compounds in a first fluoropolymer resin binder containing polyvinylidene fluoride in about 2–30 weight % to a thickness of about 20–25 microns dry;

(c) depositing to a thickness of 45–50 microns dry a phosphor in the first fluoropolymer resin binder containing polyvinylidene fluoride in about 2–30 weight %;

(d) depositing to a thickness of 10–15 microns dry a dielectric layer including a white dielectric powder in the first fluoropolymer resin binder containing polyvinylidene fluoride in about 2–30 weight %;

(e) depositing a rear electrode to a thickness of about 20–25 microns dry comprising a conductive ink in a binder; and (f) depositing a protective overcoat containing a Teflon® PFA powder in a second fluoropolymer resin binder containing polyvinylidene fluoride in about 20–80 weight % to a thickness of about 15–20 microns.

14. The method of claim 13 wherein the rear electrode is in a binder containing about 2–30 weight % polyvinylidene fluoride.

15. The method of claim 13 wherein each depositing step includes a screen printing step.

16. A method of making an EL lamp comprising the steps of:

(a) providing a ITO sputtered polyester film with a sheet resistivity between about 300 ohms and 1,000 ohms per square as the front conductor of the lamp;

(b) depositing a clear dielectric layer thereon to a thickness of 2–5 microns dry to protect the electrode from moisture and abrasion, the layer comprising a clear dielectric powder in a first fluoropolymer resin binder containing polyvinylidene fluoride in about 2–30 weight %;

(c) depositing to a thickness of 45–50 microns dry a phosphor in the first fluoropolymer resin binder containing polyvinylidene fluoride in about 2–30 weight %;

(d) depositing to a thickness of 10–15 microns dry a dielectric layer including a white dielectric powder in the first fluoropolymer resin binder containing polyvinylidene fluoride in about 2–30 weight %;

(e) depositing a rear electrode to a thickness of about 20–25 microns dry comprising a conductive ink in a binder; and (f) depositing a protective overcoat containing a Teflon® PFA powder in a second fluoropolymer resin binder containing polyvinylidene fluoride in about 20–80 weight % to a thickness of about 15–20 microns.

17. The method of claim 16 wherein the rear electrode is in a binder containing about 2–30 weight % polyvinylidene fluoride.

18. The method of claim 16 wherein the phosphor includes individually coated phosphor particles.

19. The method of claim 16 wherein each depositing step includes a screen printing step.

20. A method of making an EL lamp comprising the steps of:

(a) providing a ITO sputtered polyester film as the front conductor of the lamp;

(b) depositing a clear dielectric layer thereon to protect the electrode from moisture and abrasion, the layer comprising a clear dielectric powder in a first fluoropolymer resin binder;

(c) depositing a phosphor in the first fluoropolymer resin binder in certain areas;

(d) depositing a dielectric layer including a white dielectric powder in the first fluoropolymer resin binder;

(e) depositing a rear electrode comprising a conductive ink in a binder in a first area of the lamp;

(f) depositing a second dielectric layer including a white dielectric powder in the first fluoropolymer resin binder, said second layer overlying at least the rear electrode in the first area of the lamp;

(g) depositing a rear electrode comprising a conductive ink in a binder in a second area of the lamp, said rear electrode overlying in part the second dielectric layer; and (h) depositing a protective overcoat containing a Teflon® PFA powder in a second fluoropolymer resin binder, whereby independently controllable areas of the lamp are provided.

21. The method of claim 20 wherein said step of depositing a phosphor comprises depositing a first phosphor in certain areas and a second phosphor in other areas of the lamp whereby different colors are available in different areas of the lamp.

22. The method of claim 20 wherein each depositing step includes a screen printing step.

* * * * *